US005227599A

United States Patent [19]

Mason et al.

[11] Patent Number: 5,227,599

[45] Date of Patent: Jul. 13, 1993

[54] MICROWAVE COOKING BROWNING AND CRISPING

[75] Inventors: Charles R. Mason, Yonkers, N.Y.; Clement R. Wyss, Hillsdale; Mary A. Amini, Moorestown, both of N.J.; Ted R. Lindstrom, Tarrytown, N.Y.

[73] Assignee: Kraft General Foods, Inc., Northfield, Ill.

[21] Appl. No.: 463,751

[22] Filed: Jan. 12, 1990

[51] Int. Cl.[5] ..... H05B 6/80

[52] U.S. Cl. ..... 219/10.55 E; 219/10.55 F; 426/107; 426/234; 99/DIG. 14

[58] Field of Search ..... 219/10.55 E, 10.55 F, 219/10.55 M; 426/107, 109, 111, 113, 234, 243; 99/DIG. 14; 126/390; 229/903

[56] References Cited

U.S. PATENT DOCUMENTS

| | | | |
|---|---|---|---|
| 2,841,678 | 7/1958 | Thorson | 219/8.5 |
| 3,037,105 | 5/1962 | Kohler | 219/8.5 |
| 3,124,672 | 3/1964 | Sommer et al. | 219/8.5 |
| 3,127,674 | 4/1964 | Kohler | 228/147 |
| 3,129,459 | 4/1964 | Kullgren et al. | 219/10.491 |
| 3,365,184 | 1/1968 | Willens | 219/7.5 |
| 3,395,993 | 8/1968 | Bristow | 428/633 |
| 3,615,277 | 10/1971 | Kreider et al. | 29/195 |
| 3,639,974 | 2/1972 | Finnegan | 29/493 |
| 3,900,150 | 8/1975 | Delgrosso et al. | 228/185 |
| 3,919,764 | 11/1975 | Berghezan | 228/185 |
| 3,981,427 | 9/1976 | Brookes | 228/122 |
| 4,190,757 | 2/1980 | Turpin et al. . | |
| 4,210,477 | 7/1980 | Gillespie et al. | 156/203 |
| 4,230,924 | 10/1980 | Brastad et al. . | |
| 4,267,420 | 5/1981 | Brastad . | |
| 4,307,276 | 12/1981 | Kurata et al. | 219/10.41 |
| 4,340,650 | 7/1982 | Pattanaik et al. | 428/675 |
| 4,345,133 | 8/1982 | Cherney et al. . | |
| 4,398,659 | 8/1983 | Richter | 228/124 |
| 4,426,033 | 1/1984 | Mizuhara | 228/56 |
| 4,447,690 | 5/1984 | Grever | 219/10.43 |
| 4,454,402 | 6/1984 | Sander et al. | 219/10.53 |
| 4,468,549 | 8/1984 | Arnosky | 219/10.77 |
| 4,499,156 | 2/1985 | Smith et al. | 428/614 |
| 4,553,010 | 11/1985 | Bohrer et al. . | |
| 4,555,605 | 11/1985 | Brown et al. . | |
| 4,567,341 | 1/1986 | Brown . | |
| 4,571,337 | 2/1986 | Cage et al. . | |
| 4,590,349 | 5/1986 | Brown et al. . | |
| 4,592,914 | 6/1986 | Kuchenbecker . | |
| 4,594,492 | 6/1986 | Maroszek . | |
| 4,602,731 | 7/1986 | Dockus | 228/121 |
| 4,610,934 | 9/1986 | Boecker et al. | 428/627 |
| 4,612,431 | 9/1986 | Brown et al. . | |
| 4,621,761 | 11/1986 | Hammond et al. | 228/124 |
| 4,622,445 | 11/1986 | Matsen | 219/10.41 |
| 4,626,641 | 12/1986 | Brown . | |
| 4,630,767 | 12/1986 | mizuhara | 228/122 |

(List continued on next page.)

FOREIGN PATENT DOCUMENTS

| | | |
|---|---|---|
| 0256791 | 2/1988 | European Pat. Off. . |
| 2202118 | 9/1988 | United Kingdom . |
| 2211380 | 6/1989 | United Kingdom . |

OTHER PUBLICATIONS

Smith, P. R. et al., "Developments in Titanium Metal Matrix Composites," *Journal of Metals*, Mar. 1984, pp. 19–26.

*Primary Examiner*—Philip H. Leung

*Attorney, Agent, or Firm*—T. A. Marcoux; L. I. Grim; T. R. Sovoie

[57] ABSTRACT

A microwave cooking bag, method, and system are disclosed in which a food product in the bag is cooked, browned and crisped in a microwave oven. The bag forms an enclosed cooking space which is substantially surrounded by a susceptor material layer. The susceptor material layer is heated during cooking by the microwave radiation to a temperature sufficient to brown and crisp the food product while the microwave radiation also directly heats and thereby cooks the food product. Both a five-sided bag and a four-sided, pouch-like bag are disclosed.

39 Claims, 2 Drawing Sheets

U.S. PATENT DOCUMENTS 4,641,005 3/1987 Seiferth .
4,661,671 4/1987 Maroszek .
4,678,882 7/1987 Bohrer et al. .
4,691,374 9/1987 Watkins et al. .
4,698,271 10/1987 Moorhead ..... 428/621
4,699,849 10/1987 Das ..... 428/698
4,713,510 12/1987 Quick et al. .
4,734,288 3/1988 Engstrom et al. ..... 426/107
4,735,513 4/1988 Watkins et al. .
4,742,203 5/1988 Brown et al. .
4,745,249 5/1988 Daniels .
4,775,771 10/1988 Pawlowski et al. .
4,780,587 10/1988 Brown .
4,785,160 11/1988 Hart .
4,794,005 12/1988 Swiontek ..... 426/107
4,797,155 1/1989 Das ..... 75/229
4,808,421 2/1989 Mendenhall et al. .
4,818,545 4/1989 Kunimoto .
4,820,893 4/1989 Mode .
4,825,025 4/1989 Seiferth .
4,851,246 7/1989 Maxwell et al. .
4,851,632 7/1989 Kaliski .
4,861,958 8/1989 Bohrer et al. .
4,864,089 9/1989 Tighe et al. .
4,864,090 9/1989 Maxwell et al. .
4,866,232 9/1989 Stone ..... 219/10.55 E
4,866,371 2/1989 Mendenhall ..... 426/113
4,882,463 11/1989 Kyougoku et al. ..... 219/10.55 E
4,904,487 2/1990 Labaw et al. ..... 426/111
4,959,231 9/1990 Lakey et al. ..... 426/107
5,003,142 3/1991 Fuller ..... 219/10.55 E

MICROWAVE COOKING BROWNING AND CRISPING

FIELD OF INVENTION

The present invention relates generally to a bag for use in a microwave oven for cooking a food product and more particularly, to a microwave cooking bag in which the food product is cooked, browned, and crisped.

BACKGROUND OF THE INVENTION

Various containers have been disclosed in prior art for the microwave cooking of different food products For example, numerous bags or containers have been provided for the microwave popping of popcorn. Typically, as shown in U.S. Pat. No. 4,553,010 (Bohrer et al.), the bag or container is provided with a bottom panel coated with a microwave interactive material or susceptor material. The kernels of popcorn together with a heating oil are disposed on the bottom panel. During microwave heating, the susceptor material becomes very hot, heating the adjacent oil and causing the kernels to be popped.

A variety of disposable food receptacles have also been disclosed in U.S. Pat. No. 4,641,005 (Seiferth). The receptacles are designed to brown the exterior of the food in the receptacle. The receptacle is formed of a substrate protective layer upon which a thin layer of electrically inductive (susceptor) material is deposited. Many types of receptacles are envisioned, including serving dishes, plates or casserole dishes as well as a wrapping for foods such as a cylindrical sausage package.

In U.S. Pat. No. 4,755,160 (Hart), a disposable sleeve-type carton formed from formable paperboard and coated with an electrically conductive (susceptor) material is provided to assist in browning a food item. The top, bottom and two sidewall panels form a tubular structure, with all of the panels having the susceptor material provided thereon. Vent holes are also preferably provided in the top panel. A similar container in which the top panel does not include a susceptor material is also disclosed in U.S. Pat. No. 4,592,914 (Kuchenbecker).

Open-ended sleeves have also been disclosed in the prior art for crisping and browning foods in a microwave oven. Such sleeves include a paperboard strip with a microwave interactive layer affixed over the surface of the strip forming the sleeve. Examples of such sleeves are disclosed in U.S. Pat. No. 4,775,771 (Pawlowski et al.), and U.S. Pat. No. 4,780,587 (Brown).

The manufacturing of various containers from a base sheet having a microwave coupling layer or susceptor has been disclosed in U.S. Pat. No. 4,735,513 (Watkins et al.). In particular, a flexible gusseted pouch having a susceptor material layer along a bottom side thereof is conveniently made from a sandwich of rolled paper between which a plastic film having the susceptor layer deposited thereon is provided. A flexible bag having a bottom susceptor layer is also disclosed.

SUMMARY OF THE INVENTION

In accordance with the present invention, a flexible cooking bag for containing a food product to be cooked, browned and crisped in a microwave oven includes an enclosed cooking space. A portion of the cooking space is substantially surrounded by a susceptor material layer which is heated during cooking by the microwave radiation of the microwave oven to a temperature sufficient to brown and crisp the food product while the microwave radiation also directly heats and thereby cooks the food product. The enclosed cooking space includes a collapsed opening during cooking, the collapsed opening being formed by a sleeve extending from the susceptor material layer and designed to be folded together during cooking In one embodiment, the enclosed space is a bottom portion of the cooking bag having four rectangular sides and a bottom side, all of which are substantially covered with the susceptor layer. Opposed gussets are provided in opposed sides adjacent to the bottom side so as to form a five-sided bag. When the sleeve of the five-sided bag is collapsed, a microwave transmissive window may be formed having an area of one-third to two-thirds that of the bottom side. In another embodiment of the present invention, the enclosed space includes opposed gussets to form a gusseted pouch-like bag.

Preferably, the enclosed space and the entire bag is formed from a flat sheet to which a susceptor layer is selectively attached. The flat sheet has edges which are spaced from the susceptor layer and which are overlapped to form the enclosed space and sleeve with a portion of the overlapped edges forming a gap preferably so that the susceptor layer does not overlap.

During cooking, the susceptor material layer raises the temperature of the enclosed space to between 110 and 210 degrees C. to brown and crisp the exterior of the food product. If desired, a vent is also provided to the enclosed space.

In a preferred embodiment, the flexible cooking bag of the present invention is a microwave transmissive sleeve which is closed at one end and open at the other end. The opening of the sleeve includes a portion which is designed to be brought together as a collapsed end to provide the sleeve with an enclosed space containing the food product during cooking. The susceptor material layer is then located on the sleeve from adjacent the closed end and along the sleeve towards but stopping before the collapsed end. The susceptor layer thus surrounds the adjacent enclosed space. Either a four-sided pouch-like bag or a five-sided bag is possible.

In accordance with the present invention, a method of cooking a food product to be cooked, browned, and crisped at the same time in a microwave oven includes the initial step of placing the food product through a collapsible sleeve of a flexible cooking bag and into a cooking space. The cooking space is substantially surrounded by a susceptor material layer and the food product is only in contact with the bag where the food product rests thereon. After the sleeve of the cooking bag is folded to enclose the cooking space, the food product is then cooked in the bag in the microwave oven so that the temperature of the cooking space is raised by the heat generated by the susceptor material to that sufficient to brown and crisp the food product while the microwave radiation also directly heats and thereby cooks the food product.

In this method of cooking, the temperature in the enclosed cooking space is preferably raised to between 110 and 210 degrees C. The sleeve is also optionally folded so as to provide a window for the microwave radiation.

In the preferred embodiment the method further includes a step of initially filling the flexible cooking bag with a "Shake 'n Bake" or other type of food product coating. Then, after the food product is placed in the flexible cooking bag and the sleeve folded, the cooking bag is shaken in order to coat the food product with the coating. After cooking, the food product then has a browned, crisped coating.

The present invention also includes a system for cooking, browning, and crisping a food product including a flexible bag having an enclosed cooking space substantially surrounded by a susceptor material layer and a collapsed opening during cooking. A food coating is contained in the bag so that the food product is introduced through an opening into the bag and afterwards that opening is closed by folding. The bag is then shaken to coat the food product.

It is an advantage to the present invention that a food product is conveniently and easily cooked, browned, and crisped in a microwave oven.

It is also an advantage of the present invention that the food product is initially coated with a suitable food coating, which coating is then browned and crisped while the food product is cooked in a flexible-cooking bag.

It is a further advantage of the present invention that the coating for the food product can be placed in the flexible cooking bag, with the bag being shaken with the food product therein to coat the food product before cooking in the flexible-cooking bag.

Other features and advantages of the present invention are stated in or apparent from a detailed description of presently preferred embodiments of the invention found hereinbelow.

DETAILED DESCRIPTION OF THE PREFERRED EMBODIMENTS

Figure 1:
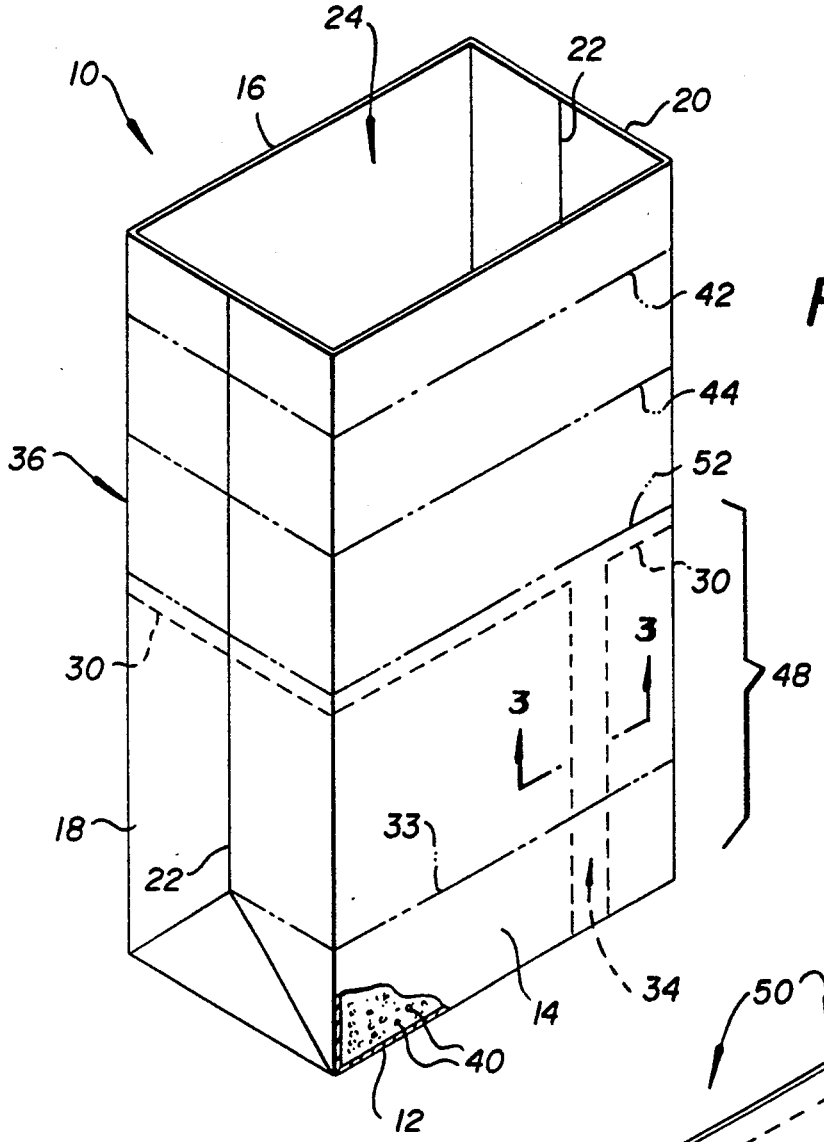
FIG. 1 is a perspective elevation view of a five-sided flexible cooking bag according to the present invention.
Figure 2:
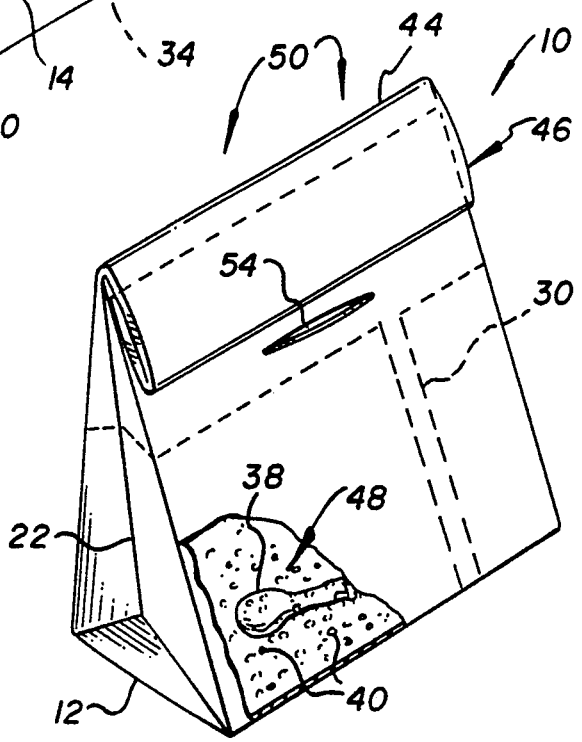
FIG. 2 is a Perspective elevation view of the cooking bag depicted in FIG. 1 in the folded position.

With reference now to the drawings in which like numerals represent like elements throughout the views, a first embodiment of a flexible-cooking bag 10 is depicted in FIGS. 1 and 2. Flexible-cooking bag 10 is formed as a five-sided bag having a bottom 12, large sides 14 and 16, and small sides 18 and 20. Small sides 18 and 20 are each provided with a gusset 22, as well known in the art so that flexible cooking bag 10 can be folded down flat for shipping, and, additionally so that an open top 24 thereof can be folded down as depicted in FIG. 2.

Flexible-cooking bag 10 is formed of two layers 26 or 28 of a suitable paper or plastic material between which is sandwiched a microwave susceptor (interactive) layer 30 as well known in the art. This multilayer configuration is preferred based on commercial feasibility but is not a limitation of the present invention. Susceptor layer 30 is provided along all of the bottom 12 as well as along approximately one-half of the height of sides 14, 16, 18, 20; although a bag having susceptor material extending up at least one-quarter of the height of the walls will produce beneficial results.

Flexible-cooking bag 10 is conveniently formed in a manner well known in the art, for example as shown in U.S. Pat. No. 4,735,513 (Watkins et al.) mentioned above. Thus, flexible cooking bag 10 is formed from a flat sheet 32 of material having susceptor layer 30 sandwiched therein. This flat sheet is suitably formed to a five-sided cooking bag 10 as depicted from flattened form (where cooking bag 10 is folded along gussets 22 and a fold line 33). However, as mentioned above, susceptor layer 30 must be positioned on this sheet so that 208 susceptor 30 only extends at least one-quarter up sides 14, 16, 18 and 20, as well as covering the entire bottom 12.

Figure 3:
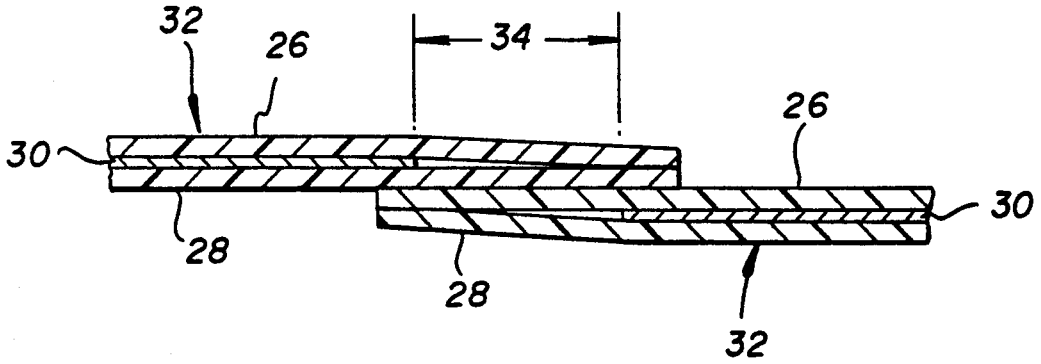
FIG. 3 is a cross-sectional view of a portion of the bag depicted in FIG. 1 taken along line 3—3.

In addition, for manufacturing convenience, at the portions of sheet 32 which overlap in forming one of the sides (as depicted large side 14), layers 26 and 28 often extend beyond the end of susceptor layer 30. This is done in order to handle the resulting laminate more easily on the bag making machine. Thus, as seen in FIG. 3, a gap 34 is often provided between the ends of susceptor layer 30 along large side 14. This gap is relatively small considering the entire area of susceptor layer 30 and this does not materially affect the performance of flexible-cooking bag 10.

As appreciated with reference to FIG. 1, sides 14, 16, 18, and 20 essentially form a sleeve 36 which is closed by bottom 12. In use, a food product 38 (such as poultry) is placed in flexible-cooking bag 10. Preferably, a food coating 40 is already provided with flexible-cooking bag 10, or is added with food product 38. Thereafter, open top 24 of flexible-cooking bag 10 is collapsed, using gussets 22 and folded first along fold line 42 and then along fold line 44. Flexible-cooking bag 10 then takes the form depicted in FIG. 2 where an open top 24 is now a collapsed opening 46 and the interior of flexible cooking bag 10 then forms an enclosed cooking space 48.

Closed-cooking bag 10 is then placed in a microwave oven which is operated for a suitable period of time. Due to the presence of susceptor layer 30 which substantially surrounds all four sides of enclosed cooking space 48 as well as being provided along bottom 12, enclosed cooking space 48 is quickly raised to a temperature of between about 110 degrees C. and 210 degrees C. At this temperature, food coating 40 (or if no food coating is provided, the exterior of food product 38) is brown and crisped. At the same time, the microwave radiation passing into flexible cooking bag 10 also cooks food product 38. At the end of the suitable time period, a cooked, browned, and crisped food Product 38 is simply removed through open top 24 (after unfolding collapsed opening 46) of flexible cooking bag 10.

As shown in FIG. 2, when sides 14 and 16 are only folded along fold lines 42 and 44, an open window 50 for microwave radiation is provided through collapsed opening 46. Window 50 is essentially a cross-sectional area which for convenience is considered as projected from directly above and onto bottom 12. This projected area is that which is not intercepted by susceptor layer 30 and hence forms a "microwave transmissive" window. Preferably, open window 50 has a projected area of about one-third to two-thirds of the area of bottom 12. The use of open window 50 allows a greater amount of microwave radiation to penetrate into flexible cooking bag 10. However, it will be appreciated that susceptor layer 30 is also transmissive to microwave radiation, as well known to those in the art.

If it is desired in cooking a particular food product or, in general, to avoid the presence of open window 50, a third fold line 52 is provided. Thus, collapsed opening 46 can be folded a third time along fold line 52 to essentially bring susceptor layer 30 of sides 14 and 16 together. However, specific fold lines are not essential to creating or eliminating the open window, i.e., the height of the bag sides may be adjusted.

It should be appreciated that collapsed opening 46 does allow some venting of enclosed cooking space 48. If desired, one or more additional vents 54 can also be provided to enclosed cooking space 48.

By way of example, a suitable flexible-cooking bag 10 for cooking two to four pieces of poultry would have a base of about five and one-half inches by seven inches and a height of ten inches. With such a flexible cooking bag 10, the height of susceptor layer 30 comprised of vacuum metallized aluminum along each side would be about five inches. The optical density of susceptor layer 30 is 0.26. The Present example utilized a vacuum metallized aluminum susceptor. However, the invention can be practiced with other susceptors which would include stainless steel alloys, printed inks containing microwave interactive materials, such as carbon, silver and the like and other susceptors known to those skilled in the art.

A bag as described above was used to cook four pieces of chicken in a microwave oven together with a suitable "Shake 'n Bake" type of food coating such as is disclosed in U.S. Pat. No. 3,586,512 (Mancuso et al.). The food product was cooked for approximately fifteen minutes. It was found that enclosed space 48 reached an initial temperature of 165 to 195 degrees C. in the first forty seconds, which temperature was held for about four minutes. Thereafter, the temperature trailed off to about 140 to 155 degrees C. at the end of cooking. The food products were found to have a fairly crisp coating and the meat was cooked and fairly juicy.

To determine the effectiveness of flexible-cooking bag 10, a flexible-cooking bag not containing a susceptor layer 30 was also used in the manner described above. While the meat can be properly cooked by selecting the optimal cooking time, it is not possible to achieve a brown and crisp exterior. It was found that the enclosed cooking space only reached a temperature of about 100 degrees C. and did not go any higher.

Other cooking bags having vacuum metallized susceptors with optical densities of 0.18 and 0.33 were also used to cook poultry in a similar manner. The results were also satisfactory, similar to those of cooking bag 10 as described above.

Raising and lowering of the susceptor height of cooking bag 10 was also considered in the tests. With the susceptor height raised one inch (essentially eliminating open window 50), it was found that enclosed cooking space 48 got even hotter, to about 200 degrees C. and then stayed hotter. The results were satisfactory. With the one inch lower susceptor height, the temperature of enclosed cooking space 48 was lowered to about 160 degrees C., but the final drop was only to about 150 degrees C. at fifteen minutes cooking. The cooking results were also satisfactory.

Another cooking bag was also used in which gap 34 was eliminated. It was found that a temperature of about 160 to 190 degrees C. was reached, and stayed generally somewhat higher than in bags containing a gap. The results were not considered quite as good as flexible cooking bag 10, but were generally satisfactory.

A cooking bag with the susceptor layer area reduced by fifty percent was also tried. The enclosed cooking space area only reached a temperature of about 140 to 150 degrees C. and stayed cooler than flexible cooking bag 10. While some sogginess was found in the coating, the results were not unsatisfactory.

The use of alternating vertical foil shielding panels and susceptor panel on cooking bags was also considered. Where the foil covered approximately fifty percent of the sides, the enclosed space temperature only reached about 120 to 140 degrees C. Further, it was found that the meat did not cook satisfactorily, although the coating was found to be crisp. With about twenty-five percent foil, the enclosed cooking space reached a temperature of 155 to 175 degrees C. and finished out at about 150 degrees C. The alternating foil and susceptor panels seemed to create greater hot and cold spots on the surfaces, and either dry or soggy coating materials.

The flexible cooking bag 10 used with an open top or slightly vented was also tried. It was found that the enclosed cooking space only reached a temperature of about 110 to 120 degrees C. It was also found that the meat was somewhat dry, although the coating was crisp. The use of a bag having small slits to be used as vents was also tried. With the use of such slits, results similar to flexible cooking bag 10 were achieved.

The raising of flexible cooking bag 10 off of the microwave oven floor was also found to increase the temperature of the enclosed space somewhat.

A cooking bag containing only a bottom susceptor was also tried. It was found that the enclosed cooking space only reached a temperature of 100 degrees C. This resulted in a soft food coating and only the bottoms of the meat were as good as the meat from cooking bag 10.

A cooking bag including a four and one-half square inch gap in the bottom from the completely covered cooking bag 10 was found to produce an enclosed cooking space temperature of 175 to 185 degrees C. and to perform much like flexible cooking bag 10. However, the bottoms of the food product tended to burn where the susceptor layer was, although the crisping was satisfactory. The use of a seventeen and one-half square inch gap was also similar, although the bottoms tended to be soggier.

Figure 4:
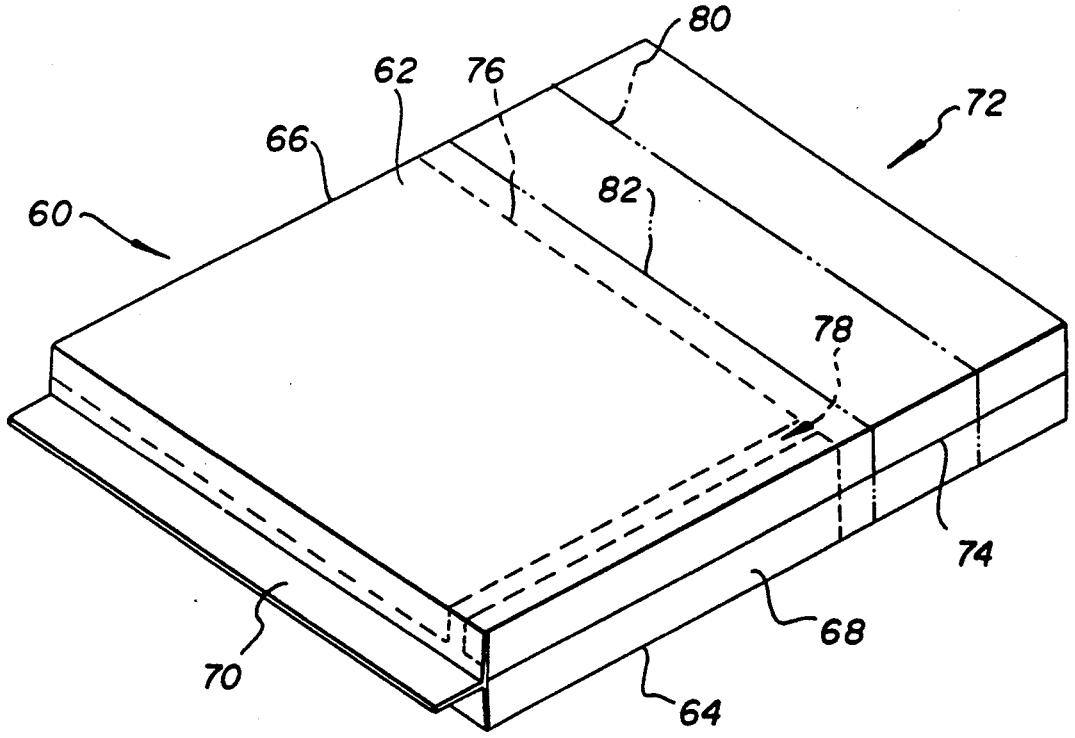
FIG. 4 is a perspective plan view of an alternative pouch-like flexible cooking bag according to the present invention.

Depicted in FIG. 4 is an alternative embodiment of a cooking bag 60 according to the present invention. Cooking bag 60 is similar to cooking bag 10 described above, but is more of a pouch-like bag shape. Cooking bag 60 includes large sides 62 and 64 and small sides 66 and 68. One of the large sides lays flat on the surface of the microwave oven during cooking. At one end of cooking bag 60, it is folded to form a closed end 70. Closed end 70 is thus opposite an open end 72. Gussets 74 are provided on each small side 66 and 68 so that cooking bag 60 can be folded flat or opened up into the position shown in FIG. 4.

Cooking bag 60 is also made of a material including a susceptor layer 76 comprised of vacuum metallized aluminum. Where the sheet used to form cooking bag 60 comes together, a gap 78 is Provided in susceptor layer 76 in a similar manner as described above with respect to flexible cooking bag 10.

Cooking bag 60 is used in a manner similar to flexible cooking bag 10. Thus, once the food products to be cooked, browned and crisped are placed in cooking bag 60, open end 72 is collapsed and folded as along fold lines 50 and 52 to form a collapsed or closed end of the sleeve forming cooking bag 60. Thus, an enclosed cooking space is formed in cooking bag 60 which behaves in a similar manner as enclosed cooking space 48 as described above with respect to flexible cooking bag 10.

In operation, either flexible cooking bag 10 or flexible cooking bag 60 is used in the following manner. Initially, the food Product is Placed through the collapsible sleeve into the enclosed cooking space. The food Product is only in contact with the bag where the food Product rests thereon or, in a case of cooking bag 60, possibly additionally in contact with the top of the bag. The sleeve forming the opening to the bag is then folded to enclose the cooking space. Then, as the cooking space is substantially surrounded by a susceptor material layer, the temperature in the enclosed cooking space is raised by heating of the susceptor material layer in a microwave oven. The temperature is raised sufficient for browning and crisping of the food product while at the same time the microwave radiation also directly heats and thereby cooks the food product. Preferably, the cooking step raises the temperature of the enclosed cooking space to between 110 and 210 degrees C.

If desired, a microwave transmissive window may be provided by incorporating a gap into a side seam of the bag or by only folding the sleeve to a distance short of the susceptor layer. Alternatively, the sleeve can be folded all the way to the susceptor material layer. In addition, if desired, a food coating is introduced through the collapsible sleeve and, after collapsing the sleeve, the cooking bag is shaken to coat the food product with the food coating.

While the present invention has been described as suitable for cooking poultry, it should be appreciated that other foods can also be cooked to impart a baked or fried appearance with desirable crispness and brown color to a microwavable food product, such as meatloaf, vegetables, dough products, hot dogs, etc. Further, the use of a crumb coating is only one type of coating which can be used, or no coating at all is necessary.

Thus, although the present invention has been described with respect to exemplary embodiments thereof, it will be understood by those of ordinary skill in the art that variations and modifications can be effected within the scope and spirit of the invention.

We claim:

1. A flexible cooking bag for containing a food product to be cooked, browned and crisped in a microwave oven comprising:

an enclosed cooking space enclosed in six general directions along three mutually perpendicular axes and having a first end, a second end opposite said first end, and an encircling member extending between said first and second ends;

a portion of said cooking space being substantially encircled by a susceptor material layer forming part of said encircling member which circumferentially extends from said first end to a circumferential termination adjacent said second end and which is heated during cooking by the microwave radiation of the microwave oven to a temperature sufficient to brown and crisp the food product while the microwave radiation also directly heats and thereby cooks the food product;

said enclosed cooking space including as said second end a collapsed opening during cooking, said collapsed opening being formed as a microwave transmissive sleeve by extensions of said encircling member extending away from said circumferential termination of said surrounding susceptor material layer and designed to be folded together during cooking.

2. A cooking bag as claimed in claim 1 wherein said encircling member has four rectangular sides and said first end is a bottom which is also substantially covered with said susceptor layer, and wherein said extensions of said four rectangular sides are rectangular and form said microwave transmissive sleeve.

3. A cooking bag as claimed in claim 2 wherein two opposed ones of said four sides include opposed gussets adjacent said bottom so as to form a foldable five-sided bag.

4. A cooking bag as claimed in claim 3 wherein said collapsed opening forms a microwave transmissive window having a projected area on the bottom of $\frac{1}{3}$ to $\frac{2}{3}$ that of said bottom.

5. A cooking bag as claimed in claim 1 wherein said encircling member and said sleeve are formed from a flat sheet to a portion of which said susceptor layer is attached, said flat sheet having edges which are spaced form said susceptor layer and which are overlapped to form said enclosed space with a portion of said overlapped edges forming a gap so that said susceptor layer does not overlap.

6. A cooking bag as claimed in claim 1 wherein said encircling member for said enclosed space includes opposed gussets to form a gusseted pouch-like bag with said first end.

7. A cooking bag as claimed in claim 1 wherein during cooking the susceptor material layer raises the temperature of the enclosed space to between 110 to 210 degrees C.

8. A cooking bag as claimed in claim 1 wherein said enclosed space also includes a vent in said sleeve.

9. A cooking bag as claimed in claim 1 wherein said first end includes a susceptor material layer and said collapsed opening is much smaller in cross-sectional layers surround substantially all of said enclosed cooking space.

10. A flexible-cooking bag for containing a food product to be cooked, browned and crisped in a microwave oven comprising:

a microwave transmissive elongate sleeve which is closed at one longitudinal end and open at the other longitudinal end, the open end of said sleeve including a portion which is designed to be brought together as a collapsed end to provide said sleeve with an enclosed space containing the food product during cooking; and a susceptor material layer which is located on said sleeve circumferentially and longitudinally from adjacent said closed end and along said sleeve towards but stopping at a longitudinal termination before said collapsed end and which encircles the adjacent enclosed space, said susceptor layer and said ends allowing some microwave radiation to pass therethrough such that during cooking in the microwave oven the microwave radiation directly heats the food product to cook the food product and directly heats the susceptor layer which in turn heats the food product to cook, brown and crisp the food product.

11. A cooking bag as claimed in claim 10 wherein said sleeve has four rectangular sides and said closed end is a bottom which is also substantially covered with said susceptor layer.

12. A cooking bag as claimed in claim 11 wherein said sleeve includes opposed gussets adjacent said bottom so as to form a foldable five-sided bag.

13. A cooking bag as claimed in claim 12 wherein said collapsed end forms a microwave transmissive window having a projected area on the bottom of $\frac{1}{3}$ to $\frac{2}{3}$that of said bottom.

14. A cooking bag as claimed in claim 10 wherein said sleeve is formed from a flat sheet to a portion of which said susceptor layer is attached, said flat sheet having edges which are spaced from said susceptor layer and which are overlapped to form said sleeve with a portion of said overlapped edges forming a gap so that said susceptor layer does not overlap.

15. A cooking bag as claimed in claim 10 wherein said sleeve includes opposed gussets to form a gusseted pouch-like bag.

16. A cooking bag as claimed in claim 10 wherein during cooking the susceptor material layer raises the temperature of the enclosed space to between 110 to 210 degrees C.

17. A cooking bag as claimed in claim 10 wherein said sleeve also includes a vent in said sleeve to the enclosed space.

18. A cooking bag as claimed in claim 10 wherein said closed end is substantially covered with a susceptor material layer and said collapsed end is much smaller in cross-sectional area than said closed end such that said susceptor material layers surround substantially all of said enclosed space.

19. A flexible-cooking bag for containing a food product to be cooked, browned and crisped in a microwave oven comprising:

a bottom upon which the food product rests, four sides upstanding from said bottom and forming a sleeve, and an open top, a portion of said sides adjacent said top being designed to be folded together as a collapsed top to provide an enclosed space containing the food product during cooking; and a susceptor material layer located along said bottom and extending from said bottom along said four sides upwards toward but stopping before the portions of said sides which are designed to be folded together such that said susceptor material layer along said sides encircles the adjacent enclosed space, said susceptor layer and said collapsed top allowing some microwave radiation to pass therethrough such that during cooking in the microwave oven the microwave radiation directly heats the food product to cook the food product and directly heats the susceptor layer which in turn heats the food product to cook, brown and crisp the food product.

20. A cooking bag as claimed in claim 19 wherein said sleeve includes opposed gussets adjacent said bottom side so as to form a foldable five-sided bag.

21. A cooking bag as claimed in claim 20 wherein said collapsed top forms a microwave transmissive window having a projected area on the bottom of $\frac{1}{3}$ to 170 that of said bottom.

22. A cooking bag as claimed in claim 19 wherein said sleeve and bottom are formed from a flat sheet to a portion of which said susceptor layer is attached, said flat sheet having edges which are spaced from said susceptor layer and which are overlapped to form said sleeve with a portion of said overlapped edges forming a gap so that said susceptor layer does not overlap.

23. A cooking bag as claimed in claim 19 wherein during cooking the susceptor material layer raises the temperature of the enclosed space to between 110 to 210 degrees C.

24. A cooking bag as claimed in claim 19 wherein said sleeve also includes a vent in said sleeve to the enclosed space.

25. A cooking bag as claimed in claim 19 wherein said collapsed top is much smaller in cross-sectional area than said bottom such that said susceptor material layer surrounds substantially all of said enclosed space.

26. A method of cooking a food product to be cooked, browned and crisped in a microwave oven comprising the steps of:

placing the food product through a collapsible sleeve of a flexible cooking bag into a cooking space, said cooking space being substantially encircled by a susceptor material layer which extends from a closed end of the sleeve to a circumferential termination adjacent a collapsible portion of the sleeve and the food product is substantially only in contact with the bag where the food product rests thereon;

folding the collapsible portion of the sleeve to enclose the cooking space; and cooking the food product in the bag in the microwave oven such that the temperature int eh enclosed cooking space is raised by heating of the susceptor material layer to that sufficient to brown and crisp the food product while the microwave radiation also directly heats and thereby cooks the food product.

27. A method of cooking as claimed in claim 26 wherein the cooking step raises the temperature of the enclosed cooking space to between 110 to 210 degrees C.

28. A method of cooking as claimed in claim 26 wherein the folding step folds the collapsible portion of the sleeve to provide a microwave transmissive window having a projected area on the closed end of the enclosed cooking space of $\frac{1}{3}$ to $\frac{2}{3}$ that of the closed end.

29. A method of cooking as claimed in claim 26 and further including: before the folding step, the step of adding a loose food coating through the collapsible sleeve for the food product; and after the folding step and before the cooking step. The step of shaking the cooking bag containing the food product and food coating to thereby coat the food product with the food coating.

30. A method of cooking as claimed in claim 29 wherein the cooking step raises the temperature of the enclosed cooking space to between 110 to 210 degrees C.

31. A system for cooking, browning and crisping a food product comprising:

a flexible bag having a closed end and a sleeve extending from said closed end for defining an enclosed cooking space, a portion of said sleeve adjacent said cooking space including a susceptor material layer which substantially encircles said cooking space and which is heated during cooking by the microwave radiation of the microwave oven to a temperature sufficient to brown and crisp the food product while the microwave radiation also directly heats and thereby cooks the food product, said enclosed cooking space including a collapsed opening during cooking, said collapsed opening being formed by a microwave transmissive sleeve portion extending away from said portion of said sleeve having said encircling susceptor material layer and designed to be folded together during cooking; and a dry food coating which is loosely contained in said bag such that the food product is introduced through said opening and into said bag containing said coating, said opening is then closed by folding of said sleeve, and said bag is then shaken to coat the food product with the loose coating whereby during subsequent microwave cooking the food product is cooked and the coating on the food product is browned and crisped.

32. A cooking bag as claimed in claim 31 wherein said sleeve has four rectangular sides and said closed end is a bottom which is also substantially covered as well with said susceptor layer.

33. A cooking bag as claimed in claim 32 wherein two opposed ones of said sides include opposed gussets adjacent said bottom so as to form a foldable five-sided bag.

34. A cooking bag as claimed in claim 33 wherein said collapsed end forms a microwave transmissive window having a projected area on the bottom of $\frac{1}{3}$ to $\frac{2}{3}$ that of said bottom.

35. A cooking bag as claimed in claim 31 wherein said enclosed space and sleeve are formed from a flat sheet to a portion of which said susceptor layer is attached, said flat sheet having edges which are spaced from said susceptor layer and which are overlapped to form said enclosed space with a portion of said overlapped edges forming a gap so that said susceptor layer does not overlap.

36. A cooking bag as claimed in claim 31 wherein said sleeve which defines said enclosed space includes opposed gussets to form a gusseted pouch-like bag with said closed end.

37. A cooking bag as claimed in claim 31 wherein during cooking the susceptor material layer raises the temperature of the enclosed space to between 110 to 210 degrees C.

38. A cooking bag as claimed in claim 31 wherein said enclosed space also includes a vent in said sleeve.

39. A cooking bag as claimed in claim 31 wherein said closed end includes a susceptor material layer and said collapsed opening is much smaller in cross-sectional area than said closed end such that said susceptor material layers surround substantially all of said enclosed cooking space.

* * * * *